US010905182B2

(12) United States Patent
Couch

(10) Patent No.: US 10,905,182 B2
(45) Date of Patent: Feb. 2, 2021

(54) BONNET WIG

(71) Applicant: Ivy R. Couch, Fairburn, GA (US)

(72) Inventor: Ivy R. Couch, Fairburn, GA (US)

( * ) Notice: Subject to any disclaimer, the term of this patent is extended or adjusted under 35 U.S.C. 154(b) by 182 days.

(21) Appl. No.: 15/158,256

(22) Filed: May 18, 2016

(65) Prior Publication Data

US 2016/0338437 A1 Nov. 24, 2016

Related U.S. Application Data

(60) Provisional application No. 62/162,861, filed on May 18, 2015.

(51) Int. Cl.
*A41G 3/00* (2006.01)

(52) U.S. Cl.
CPC ..... *A41G 3/0041* (2013.01); *A41G 3/0016* (2013.01)

(58) Field of Classification Search
CPC .. A41G 3/0041; A41G 3/0008; A41G 3/0016; A41G 3/00; A41G 3/0058; A41G 3/005; A45D 8/40
See application file for complete search history.

(56) References Cited

U.S. PATENT DOCUMENTS 3,665,940 A * 5/1972 Schordalides ..... A41G 3/00 132/53
3,734,105 A * 5/1973 Borghese ..... A41G 3/0041 132/53
3,835,867 A * 9/1974 Molinario ..... A41G 3/0016 132/201
3,910,292 A * 10/1975 Izzo ..... A41G 5/0093 132/53
2004/0168696 A1* 9/2004 Cox ..... A41G 3/0016 132/54
2014/0109925 A1* 4/2014 Fisher ..... A41G 3/0041 132/54
2016/0113342 A1* 4/2016 Park ..... A41G 3/005 132/54
2016/0295944 A1* 10/2016 Kim ..... A41G 3/005

FOREIGN PATENT DOCUMENTS

JP WO8904122 * 5/1989

* cited by examiner

*Primary Examiner* — Rachel R Steitz
*Assistant Examiner* — Brianne E Kalach
(74) *Attorney, Agent, or Firm* — Deanna L. Baxam

(57) ABSTRACT

A protective covering for a person's hair covers the hair with a slack foundation and is secured by a form fitting band, the form fitting band serving as a perimeter base of the foundation. The foundation includes a plurality of hair-receiving guidelines, which indicate hair placement for hair strands. The guidelines are positioned across the foundation. The band is preferably Lyrca, such that it can fit different head sizes of different persons. To help improve the fit, a retaining strap is provided for each temporal region, as well as ergonomic contours along the band that conform to a person's ears. Within the foundation is an enclosed region, including head-receiving portion and voluminous hair-protecting portion. The latter portion ensures sufficient space to protect and maintain a person's natural hair and hairstyle. An internal netting helps to catch shedding hairs while a drawstring in the band allows for tightness to be adjusted.

7 Claims, 9 Drawing Sheets

BONNET WIG

The current application claims a priority to the U.S. Provisional Patent application Ser. No. 62/162,861 filed on May 18, 2015.

FIELD OF THE INVENTION

The present invention relates generally to an aesthetic headgear that is worn over a person's natural hair while providing sufficient space to protect the natural hair. Further, the present invention is suitable for use in both public and private environments.

BACKGROUND OF THE INVENTION

Wigs are a common accessory used for a variety of purposes. Some persons use wigs as fashion accessories or as part of a costume, allowing them to display a hair style or color other than that of their natural hair. For others, wigs are used to maintain the appearance of a full head of hair; this might be desirable for those whose hair is thinning or falling out due to old age or perhaps medical treatments, a common example being chemotherapy. There a large number of wigs that are available, addressing different desires in terms of designs and applications.

Existing wig designs tend to be tight and form fitting, helping to hold the wig in place. However, resulting from those properties are some notable drawbacks. Some drawbacks include the lack of ventilation for a person's head and the untidying, disruption, or even damage to a person's natural hair beneath the wig.

Other headgear, for more functional purposes, is intended to be worn over a person's hair while sleeping. These types of headgear serve as a means of hair protection. These types of headgear are effective with respect to their intended purpose, but are often considered to be unaesthetic, lacking in terms of stylistic options and generally unsuitable for wear in public.

It is an object of the present invention to address the drawbacks of the prior art by providing a headgear (e.g. bonnet) with connected hairs. The present invention may be produced in a variety of hair styles and colors, and protects a person's natural hair when worn. The present invention may be worn anywhere, whether in the home or out in public.

DETAIL DESCRIPTIONS OF THE INVENTION

All illustrations of the drawings are for the purpose of describing selected versions of the present invention and are not intended to limit the scope of the present invention.

Figure 1:
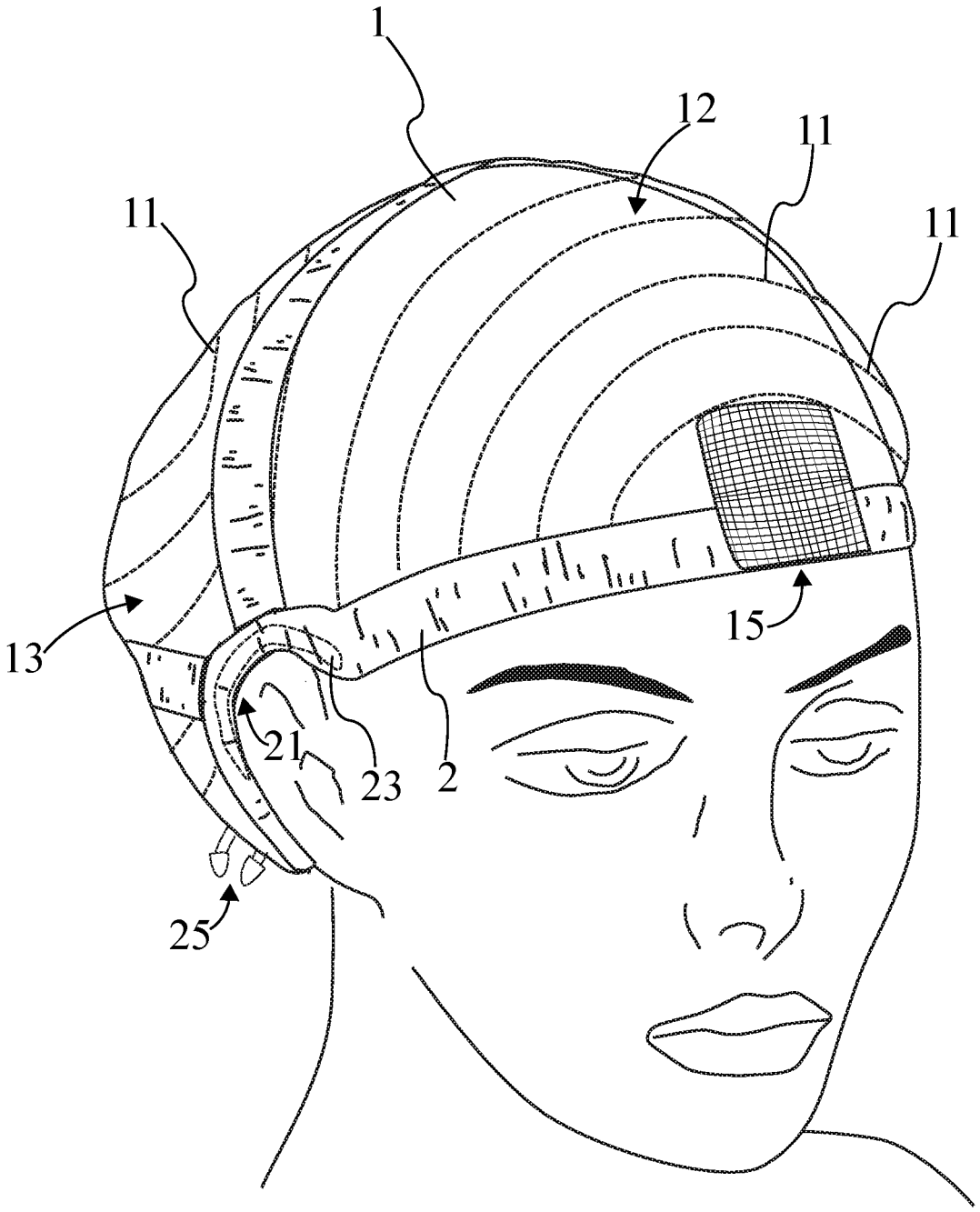
FIG. 1 is a perspective view of the present invention, with hair omitted for ease of disclosure.
Figure 2:
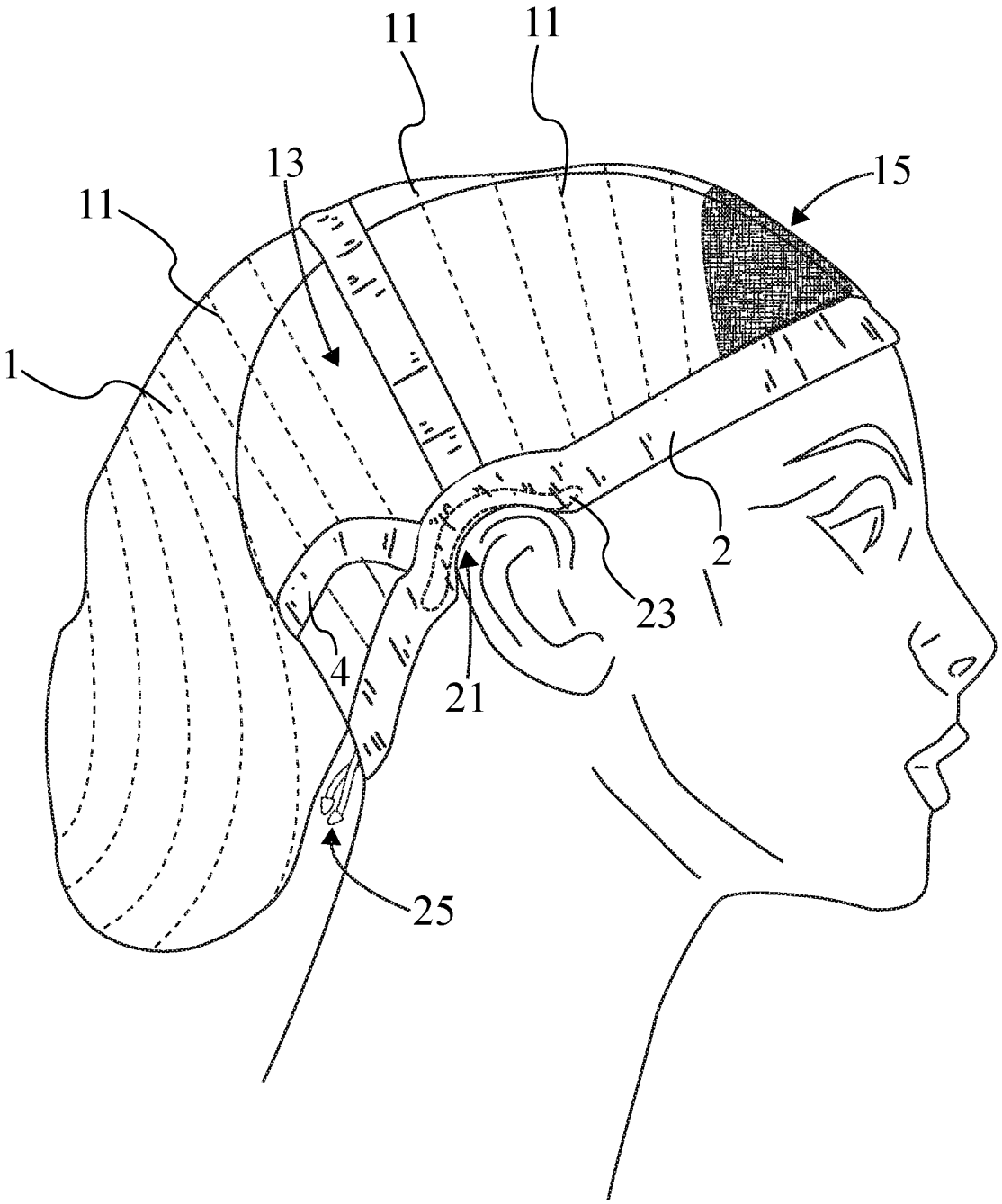
FIG. 2 is a left side view of the present invention, with hair omitted for ease of disclosure.
Figure 3:
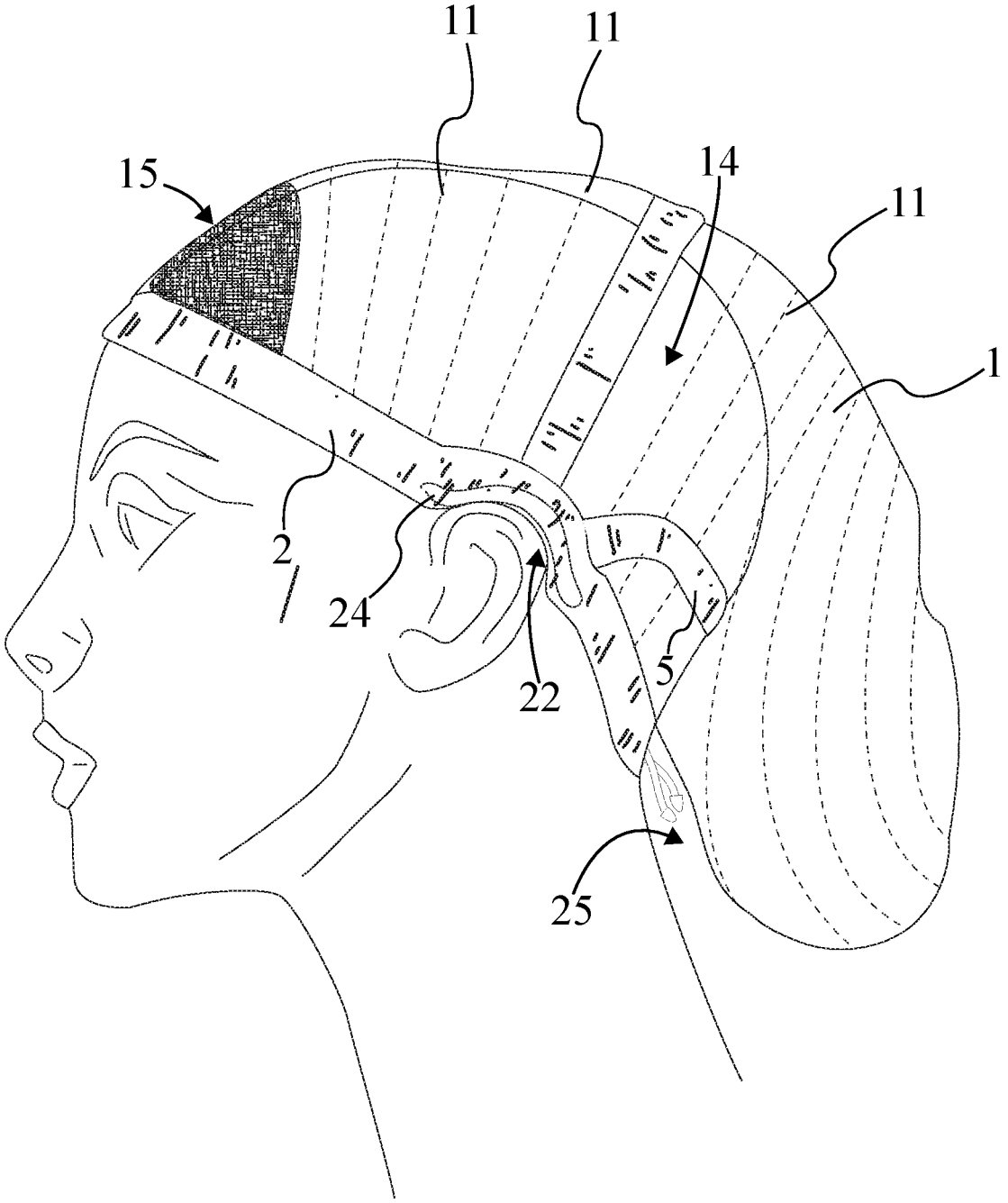
FIG. 3 is a right side view of the present invention, with hair omitted for ease of disclosure.
Figure 4:
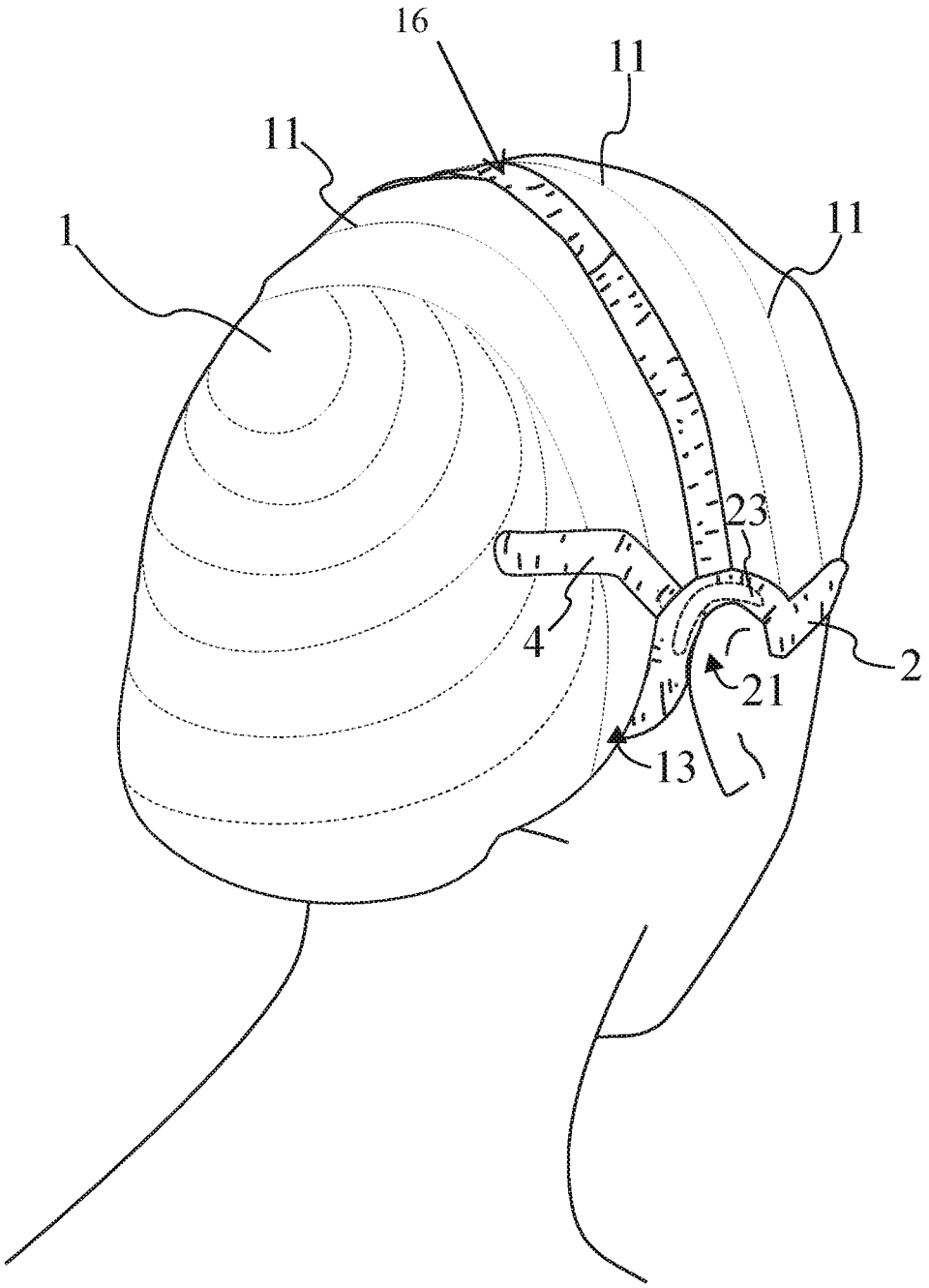
FIG. 4 is a rear perspective view of the present invention, with hair omitted for ease of disclosure.
Figure 5:
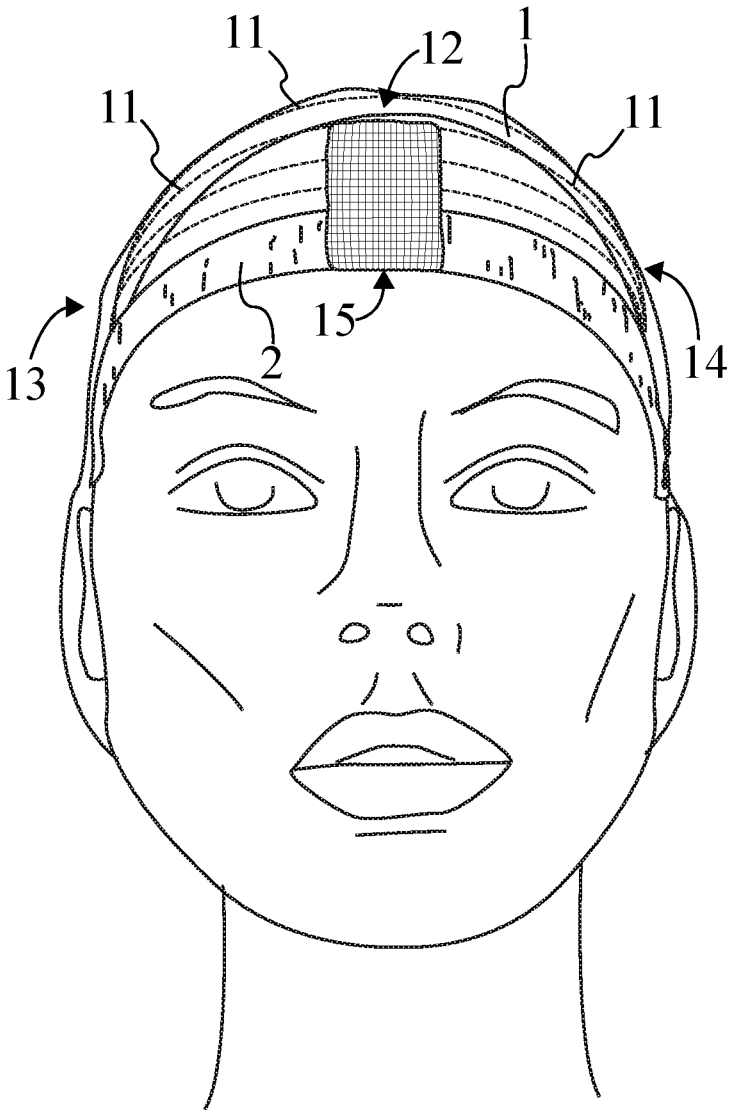
FIG. 5 is a front view of the present invention, showing a hairline region added to a frontal region, with hair omitted for ease of disclosure.
Figure 6:
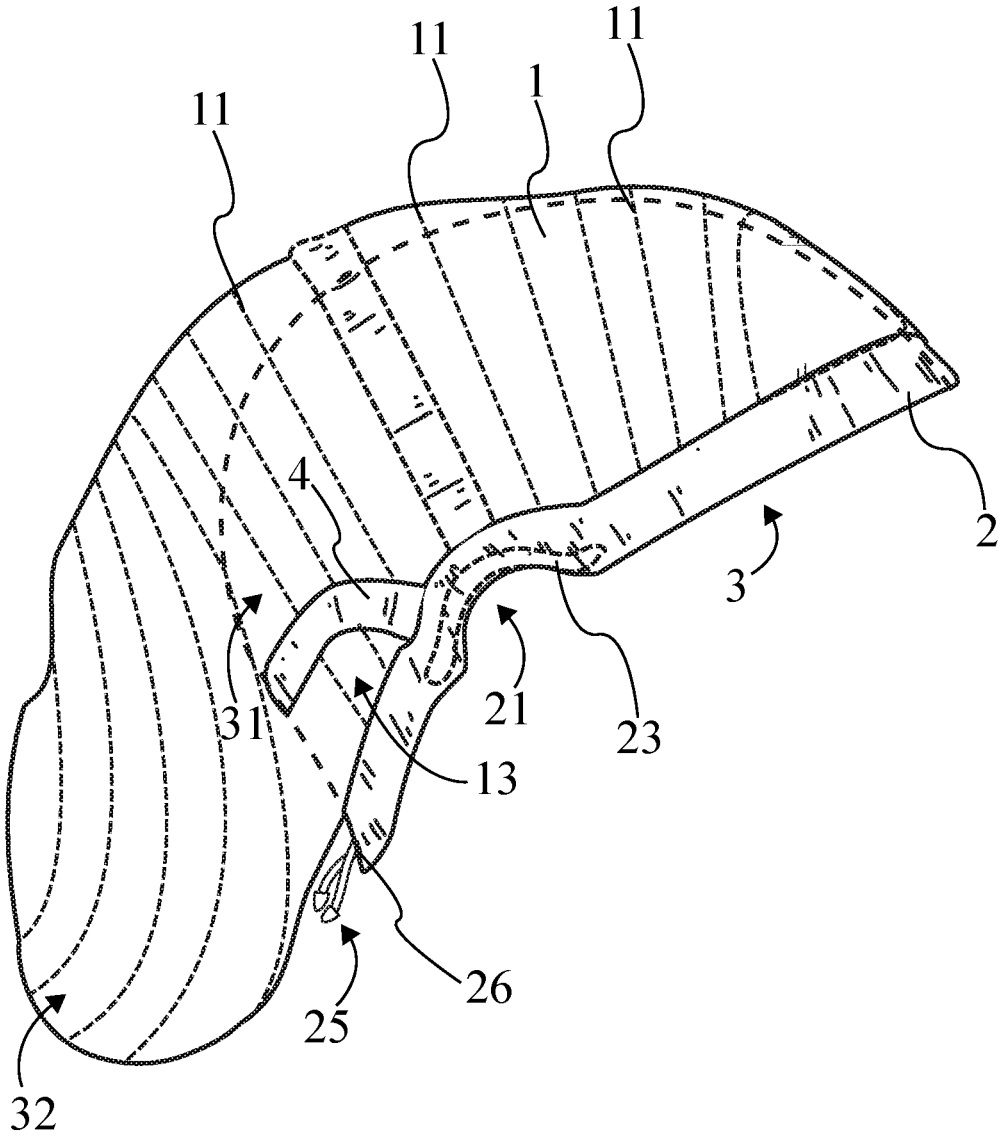
FIG. 6 is a right side view of the present invention showing the outline of a head and the corresponding voluminous interior space provided for a person's head and hair.
Figure 7:
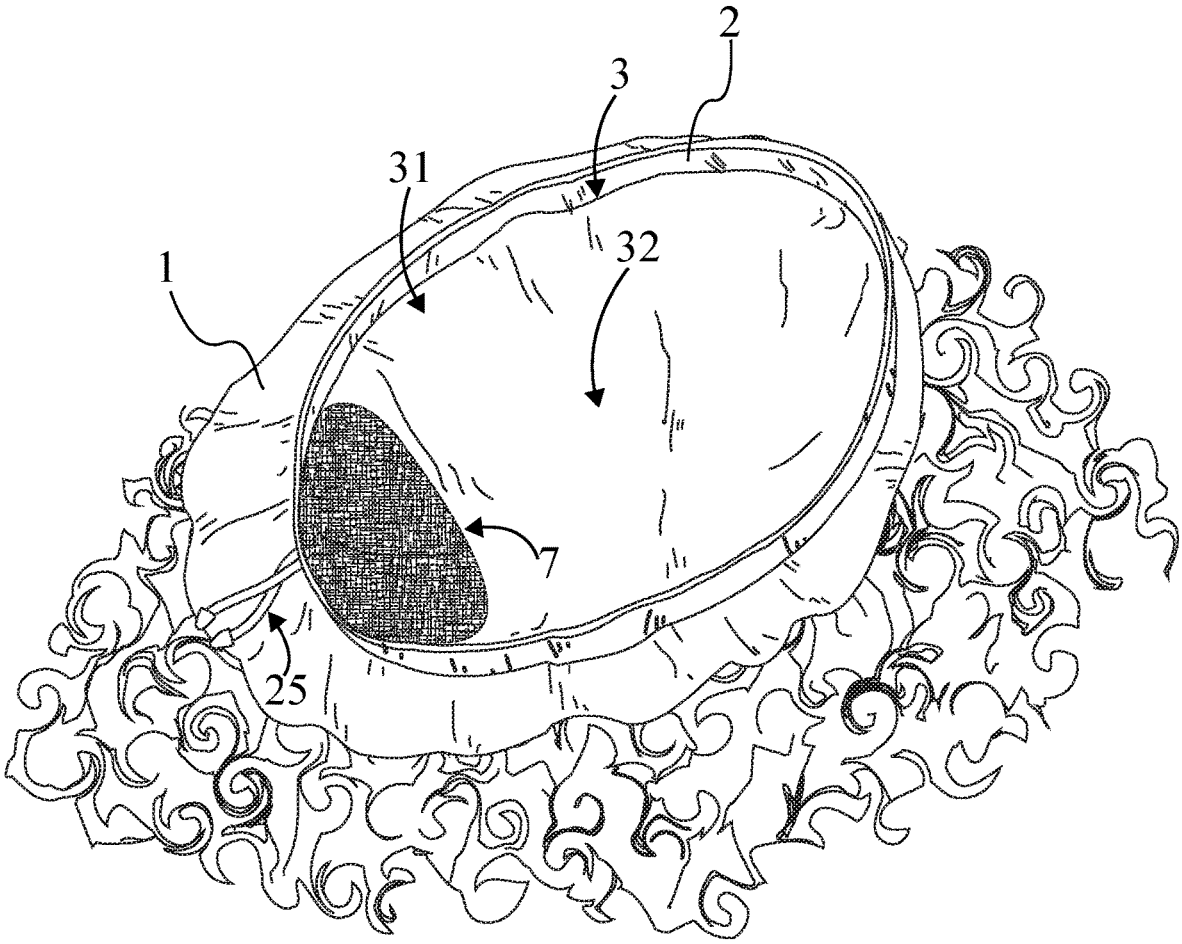
FIG. 7 is a bottom perspective view of the present invention, showing an enclosed region.
Figure 8:
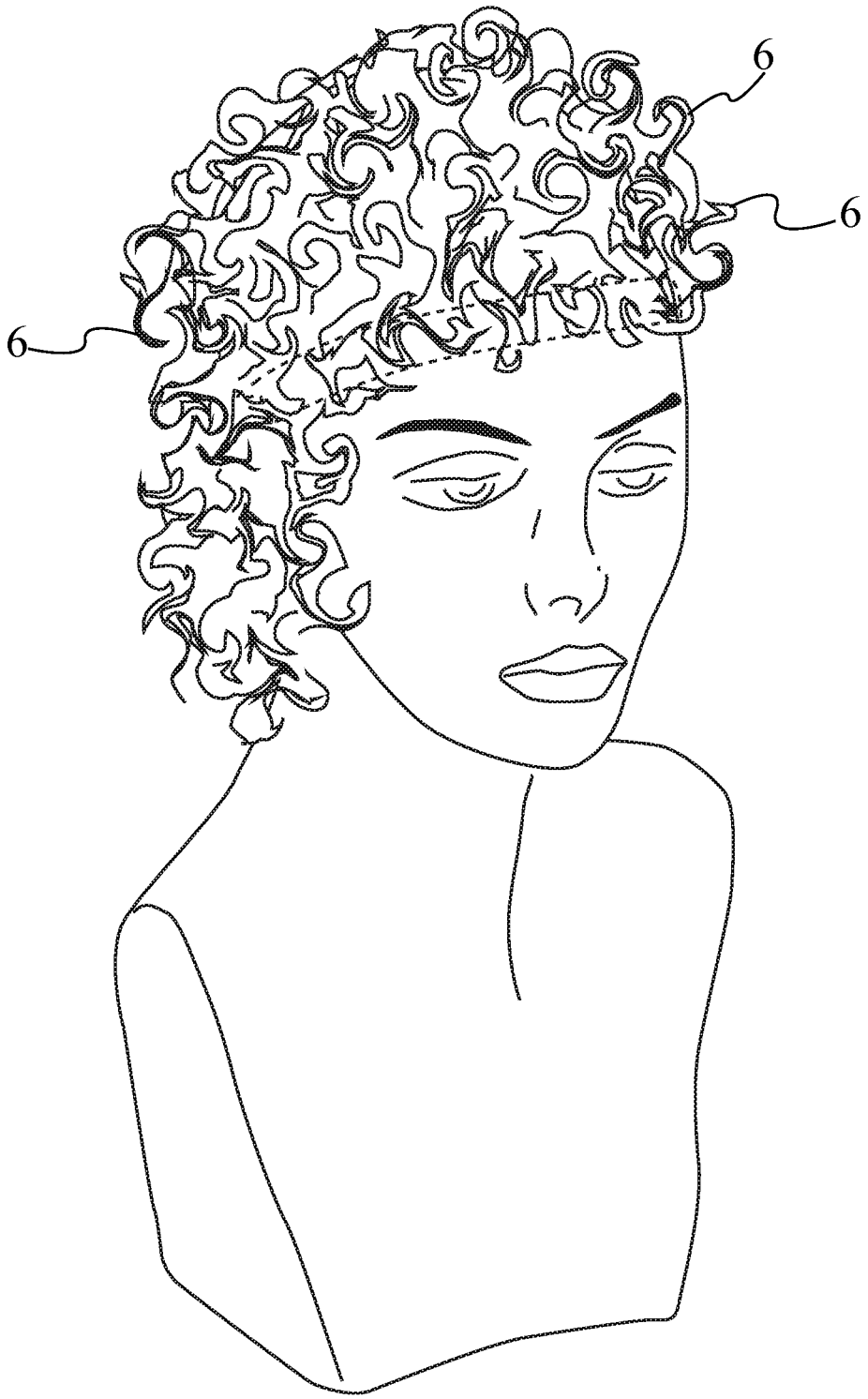
FIG. 8 is a perspective view showing a person wearing the full present invention, with a band outlined in dotted line.
Figure 9:
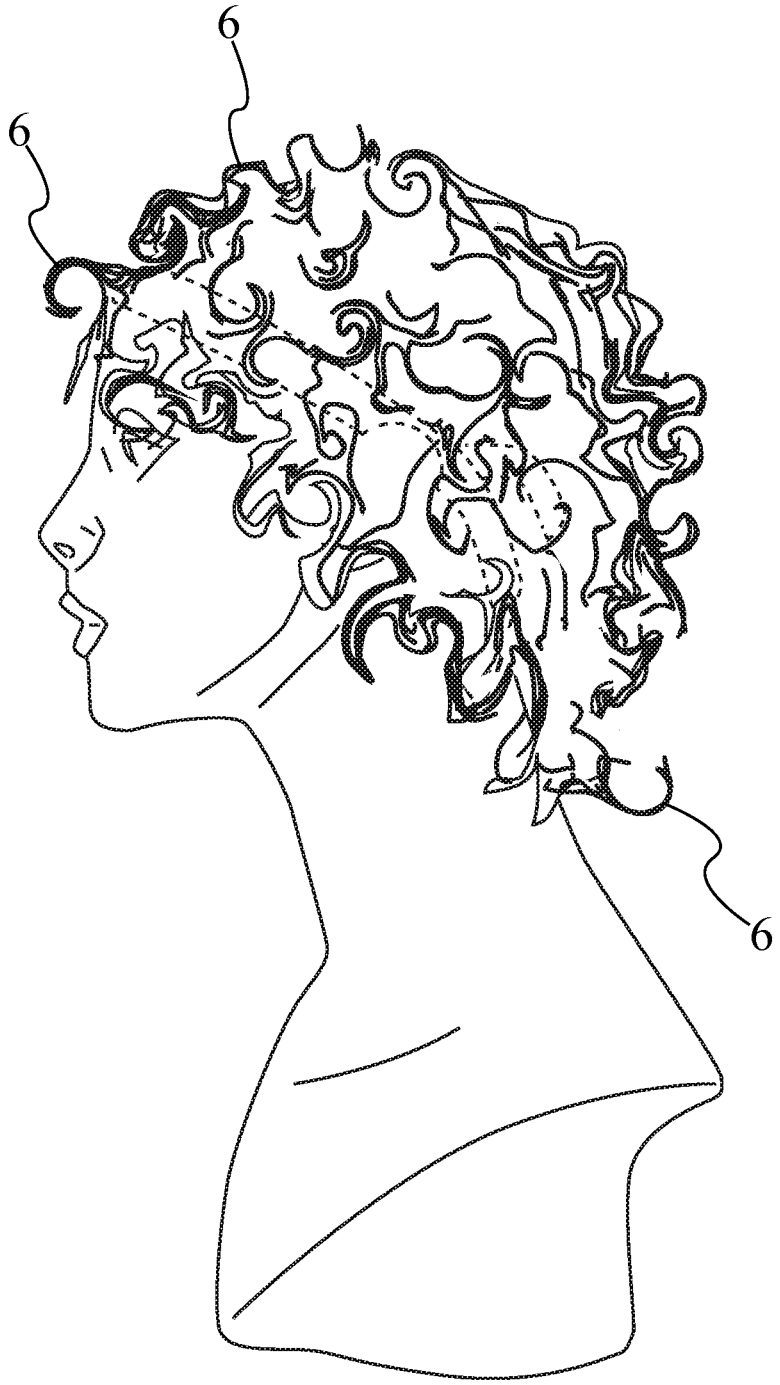
FIG. 9 is a right side view showing a person waring the full present invention, with a band outlined in dotted line.

The present invention is an improved hair-protecting bonnet-style wig that provides a generous internal space that helps maintain a person's regular hairstyle and additional serves to capture and contain any hairs that fall out. To this end, the present invention comprises a slack foundation 1, a band 2, and an enclosed region 3. The slack foundation 1 is the primary body of the bonnet-style wig, to which hairs are connected and which is placed over a user's head. The band 2, which is connected around the edge of the slack foundation 1 to form a perimeter and base of the slack foundation 1, secures the present invention to a person's head. The band 2 is thus form fitting, creating a gentle pressure about a wearer's head that helps hold the bonnet-style wig in position. The slack foundation 1 itself, unlike the band 2, is not form fitting. Rather, the slack foundation 1 is a loose and flexible piece that allows ample room (i.e. the enclosed region 3) for a person's head and hair. The enclosed region 3 is interior to the slack foundation 1, with the volume of the enclosed region 3 being bounded by the slack foundation 1 and the band 2. Effectively, the enclosed region 3 is a dome-shaped volume formed within the bonnet-style wig. The enclosed region 3 is larger than a person's head in order to provide additional space that helps maintain a natural hairstyle underneath the bonnet-style wig. The present invention is illustrated via FIG. 1-FIG. 9.

In order to provide ample room for a person's natural hair, as stated above, the slack foundation 1 is preferably semi-ellipsoidal in shape. A flat edge of this semi-ellipsoidal shape is defined by the band 2. This shape resembles a dome, creating sufficient volume for a person's head as well as natural hairstyle. The volume enclosed by the semi-ellipsoidal foundation is greater than the volume enclosed by the band 2, as the band 2 is meant to be form-fitting with respect to a user's head while the slack foundation 1 is meant to be loose and spacious.

Further defining the above components, the slack foundation 1 comprises a plurality of hair-receiving guidelines 11, a frontal region 12, a first temporal region 13, and a second temporal region 14. The plurality of hair-receiving guidelines 11 is printed onto the slack foundation 1, serving as a pattern for attaching hair to the bonnet-style wig. The frontal region 12, the first temporal region 13, and the second temporal region 14 define different parts of the slack foundation 1. The first temporal region 13 and the second temporal region are 14 adjacently connected to opposite ends of the frontal region 12, with the two temporal regions serving as the sides of the slack foundation 1. The frontal region 12, first temporal region 13, and second temporal region 14 are curved, rather than flat, to better represent the shape of the human head. The plurality of hair-receiving guidelines 11 is patterned along the regions of the slack foundation 1, including the frontal region 12, the first temporal region 13, and the second temporal region 14. The first temporal region 13 and the second temporal region 14 cover the sides of a user's head, while the frontal region 12 covers the front section of a user's head. More specifically, the two temporal regions overlap the ears of a user while the frontal region 12 overlaps the front part of the scalp, just above the forehead.

The enclosed region 3, which receives a person's head and natural hair, comprises a head-receiving portion 31 and a voluminous hair-protecting portion 32. The head-receiving portion 31 is the area adjacent to the band. The head-receiving portion 31 is intended to contain the skull and scalp of a user. The voluminous hair-protecting portion 32 is positioned between the head-receiving portion 31 and the slack foundation 1. The voluminous hair-protecting portion 32 is provided for containing the hair of a user; this voluminous hair-protecting portion 32 is effectively a gap between the top of a user's head and the slack foundation 1. The gap provides ample room for a user's natural hair style, allowing the present invention to easily and quickly be donned or removed without damaging or disrupting the user's natural hair and hairstyle. While the exact amount of space provided is ultimately not restricted by the present invention, in the preferred embodiment the width of the enclosed region 3 is 18½ inches, providing ample interior space for the woman's natural hair to remain within the bonnet-style wig.

To help create a more realistic bonnet-style wig, the frontal region 12 comprises a hairline region 15. The manner in which the hairline region 15 is created is not restricted by the present invention; as one example, a synthetic scalp piece is mounted onto the slack foundation 1 in the forehead area; of course, other implementations remain possible. This subsection of the frontal region 12 is positioned adjacent to the band, and centered between the first temporal region 13 and the second temporal region 14. The hairline region 15 imitates the boundary between the scalp and the forehead. This addition helps to better represent an authentic and natural head of hair. Correspondingly, the plurality of hair-receiving guidelines 11 is positioned around the hairline region 15. Thus, the hairline region 15 helps to create the illusion of hair coming out naturally. The material for the hairline region 15 may be a lace skin that is visually similar to a natural scalp.

Describing the hairline region 15 in more detail, a mesh or similar styled construction is used for the hairline region 15 of the slack foundation 1. This provides two benefits. First, hairs (whether natural or synthetic) may still be connected in the hairline region 15, with individual hairs being connected to the lattice structure of the mesh construction. Second, the mesh construction allows a person's skin to be seen through the frontal region 15, creating a more realistic appearance with respect to the scalp. This is advantageous for persons experiencing significant hair loss.

To provide a more comfortable and secure fit between the band 2 and a user's head, the band 2 comprises a first ergonomic contour 21 and a second ergonomic contour 22. The first ergonomic contour 21 is positioned adjacent to the first temporal region 13 of the slack foundation 1, while the second ergonomic contour 22 is positioned adjacent to the second temporal region 14 of the slack foundation 1. The first ergonomic contour 21 and the second ergonomic contour 22 are curved to match the natural shape of a person's ears, such that the band 2 has a concave section on either side that follows the perimeter of a person's ears. This creates a more comfortable fit compared to embodiments that omit the ergonomic contours from the band 2.

Further improving the fit of the band 2, the present invention comprises a first pliable member 23 and a second pliable member 24. These two members are flexible rubber pieces that allow the band 2 to adapt its shape (to a degree) along the first ergonomic contour 21 and the second ergonomic contour 22. The first pliable member 23 is thus adjacently connected to the band 2 along the first ergonomic contour 21, while the second pliable member 24 is adjacently connected to the band 2 along the second ergonomic contour 22. Preferably, the first pliable member and the second pliable member are sewn to the band 2, but other connection means are possible. The two pliable members are preferably hidden, for example being sleeved inside the band 2 or connected along an inside surface of the band 2 within the bonnet-style wig.

While the band 2 is the primary means by which the present invention is secured about a user's head, it is preferable for auxiliary securing means to be provided. Resultantly, the preferred embodiment comprises a first retaining strap 4 and a second retaining strap 5. The first retaining strap 4 and the second retaining strap 5 are connected adjacent the slack foundation 1, with the first retaining strap 4 being positioned in the first temporal region 13 and the second retaining strap 5 being positioned in the second temporal region 14. Effectively, the first retaining strap 4 and the second retaining strap 5 are positioned adjacent to a person's ears when the present invention is worn. The foundation 1 adjacent to the two retaining straps can be placed over a person's ears or alternatively tucked behind a person's ears.

The first retaining strap 4 and the second retaining strap 5 are preferably elastic, allowing them to press against a user's head behind the ear and help to better hold the present invention in place. The band 2 itself, similarly, is elastic in one embodiment of the present invention. The elastic construction of the band 2 allows for the present invention to be compatible with a variety of head shapes and sizes, as the band 2 can simply stretch to match different shapes and sizes. These elastic components can be made from a variety of materials with the appropriate properties, one example being lycra (also known as spandex).

Potentially, a circumferential retaining strap, similar to the first retaining strap 4 and the second retaining strap 5, is connected across the top of the foundation. This circumferential retaining strap 16 runs from the first temporal region 13 to the second temporal region 14, acting similar to an elastic headband for the present invention. This circumferential retaining strap helps to provide an improved fit between the slack foundation 1 and a person's head, as compared to embodiments which omit the circumferential retaining strap.

As the present invention is a bonnet-style wig, it additionally comprises a plurality of hair strands 6. The plurality of hair strands 6 is distributed along each of the plurality of hair-receiving guidelines 11, simulating a full head of natural hair. This allows for several different "patterns" to be created on a foundation, making it easier for the plurality of hair strands 6 to be connected in a desired style. The source material for the plurality of hair strands 6 may be human or synthetic. The plurality of hair strands 6, in combination with the foundation, creates the appearance of a normal hairstyle on the outside, such that it is not recognizable that a person is wearing a bonnet-style wig.

In the preferred embodiment, to better enable adaption of the band 2 for different head sizes and shapes, a drawstring 25 is sleeved by the band 2. The drawstring 25 can be tightened or loosened to comfortably secure the present invention about a user's head. The drawstring 25 is made accessible by a hidden access 26 that traverses into the band 2, allowing a user to manipulate the drawstring 25 in order to loosen or tighten the band 2. The drawstring 25 not only helps to adjust the fit, but also makes it easier for a person to don or remove the present invention by loosening and tightening the band 2 as necessary.

While the preferred embodiment comprises the drawstring 25 alongside an elastic band 2, in other embodiments either of these components may be omitted. For example, in one embodiment the present invention only comprises the elastic band 2, while in another embodiment the present invention comprises the drawstring 25 sleeved by a non-elastic band 2. These two embodiments are just a few examples of potential alternatives for the specific implementation of the band; further alterations, additions, substitutions, and such remain possible within the scope of the present invention.

The voluminous hair-protecting portion 32 of the present invention, as earlier reference, can be helpful for catching hair that falls from a person's head. This can be especially desirable for those undergoing certain treatments such as chemotherapy, which often results in loss of hair. In such situations, the present invention not only serves as a bonnet-style wig but also serves as a means to easily collect lost hair for later disposal. To assist with collection of hair that falls out, the present invention comprise a hair-catching net 7 which is connected across the interior of the slack foundation 1. In other words, the hair-catching net 7 is on the opposite surface as the plurality of hair strands 6. The hair-catching net 7 is positioned at a rearward position; that is, opposite the frontal region 12 around the slack foundation 1. It is connected within the slack foundation 1 along a coronal plane (i.e. perpendicular across the slack foundation 1 from the left side to the right side). It is noted that the hair-catching net 7 is positioned to help catch a person's natural hair which is within the slack foundation 1, rather than the simulated hair which is connected across the exterior of the slack foundation 1.

Further possibilities for the present invention include adaptions regarding coverage of the bonnet-style wig. That is, part of the slack foundation 1 may be left visible, especially around the frontal region 12. The exposed areas of the slack foundation 1 appear as a scarf, allowing for further aesthetic options in combination with those already offered in terms of hair style, type, and color. Continuing with this example, a scarf (if included) can comprise two loose ends at the rear; a person could then use the scarf to further adjust the tightness of the bonnet-style wig by tying the two loose ends together.

The components and configuration of the present invention provide several notable advantages for potential consumers. As an example, the voluminous hair-protecting portion 32 provides ample room and space for a person's natural hair. Within the voluminous hair-protecting portion 32, a person's hair is provided a degree of freedom as it is not restricted by interior width of the slack foundation 1. Resultantly, the present invention can simply be placed over a person's head with minimal or even no preparation. The present invention can thus be quickly donned and worn in a variety of environments, examples of which include professional (work) sites, fitness centers such as gyms, sporting events (both as a participant and a spectator), and ultimately anywhere a person desires to go while wearing the present invention. Further, the present invention is suitable for persons of all ages, including children and adults. The present invention provides a safer and easier way to protect the scalp and natural hair of a user, regardless of the condition of said scalp and hair. The present invention is also able to catch hair that may be falling out due to treatment, both at night and during the day.

Another advantage of the present invention is the improved ability for a person's natural hair to breathe. Traditionally, wigs are fully form-fitting, which has several drawbacks. One drawback is the inability to maintain a regular hairstyle underneath the wig, as the wearer's natural hair is pressed into a matted appearance. Another notable drawback is the lack of ventilation; since there is minimal space for the wearer's head and hair, wearing the wig can prove uncomfortably tight and hot, especially when worn for a long period of time.

Although the invention has been explained in relation to its preferred embodiment, it is to be understood that many other possible modifications and variations can be made without departing from the spirit and scope of the invention as hereinafter claimed.

What is claimed is:

1. A bonnet hair device which can be worn over a user's natural hairstyle to loosely contain said hairstyle, comprising:

an enclosed head-receiving portion formed by an annular band and retaining straps;

the annular band forming a perimeter of the hair device configured to fitting secure around a circumference of a user's head via an enclosed drawstring, the annular band further comprising first and second pliable members located proximate respective ergonomic contours of the band configured to be shaped to receive ears of the user;

first and second retaining straps connected to the annular band proximate respective ergonomic contours, each of the first and second retaining straps having a respective free end remote from the annular band and configured to fittingly engage the contour of the user's head;

a circumferential retaining strap extending from and connecting opposing sides of the band proximate to each of the ergonomic contours;

where the annular band and retaining straps are configured to fittingly secure to and enclose a user's head;

a slack foundation configured to form a loose and flexible enclosure for a user's natural hairstyle and to surround the head-receiving portion;

the slack foundation connected at its perimeter to the annular band, and the slack foundation defining a buffer portion with a larger internal volume than the head-receiving portion such that a gap is formed between the head-receiving portion and the slack foundation;

the slack foundation further comprising a plurality of hair-receiving guidelines for attaching hair.

2. The bonnet hair device as claimed in claim 1 comprising:

a frontal region comprising a hairline region; the hairline region being positioned adjacent to the band; and the plurality of hair-receiving guidelines being positioned around the hairline region.

3. The bonnet hair device of claim 2 wherein the hairline region is comprised of a lace skin having a lattice structure which allows the user's skin to be seen through the frontal region; wherein individual hairs are connected to the lattice structure of lace skin.

4. The bonnet hair device as claimed in claim 1 wherein the annular band is elastic.

5. The bonnet hair device as claimed in claim 1, wherein the slack foundation is defined by a hair-catching net.

6. The bonnet hair device of claim 1 wherein part of the slack foundation forms an exposed region which comprises a scarf having two opposing loose ends.

7. A method of collecting hair falling from the head of a chemotherapy patient for later disposal while also covering the whole head of the patient and containing all of the patient's natural hairstyle, comprising applying to the patient's head a bonnet hair device according to claim 1.

* * * * *